US005180292A

United States Patent [19]

Abousabha et al.

[11] Patent Number: 5,180,292

[45] Date of Patent: Jan. 19, 1993

[54] RADIAL COMPRESSOR WITH DISCHARGE CHAMBER DAMS

[75] Inventors: Naji G. Abousabha, Youngstown; Khanh C. Tran, Lockport, both of N.Y.

[73] Assignee: General Motors Corporation, Detroit, Mich.

[21] Appl. No.: 751,370

[22] Filed: Aug. 28, 1991

[51] Int. Cl.[5] ..... F04B 1/04

[52] U.S. Cl. ..... 417/273; 417/312; 181/403

[58] Field of Search ..... 417/271, 273, 312; 181/403, 264

[56] References Cited

U.S. PATENT DOCUMENTS

| | | | |
|---|---|---|---|
| B 416,933 | 1/1975 | Gaines et al. | 417/273 |
| 600,258 | 3/1898 | Cramer | 417/273 |
| 603,805 | 5/1898 | Wood | 417/273 |
| 3,887,301 | 6/1975 | Henkel | 417/273 |
| 3,924,968 | 12/1975 | Gaines | 417/273 |
| 4,332,532 | 6/1982 | Liska | 417/273 |
| 4,363,607 | 12/1982 | Eichele | 417/273 |
| 4,673,337 | 6/1987 | Miller | 417/273 |
| 4,690,619 | 9/1987 | Iijima et al. | 417/269 |
| 4,861,234 | 8/1989 | Joy et al. | 417/273 |

*Primary Examiner*—Richard A. Bertsch
*Assistant Examiner*—Peter Korytnyk
*Attorney, Agent, or Firm*—Ronald L. Phillips

[57] ABSTRACT

A radial compressor for a vehicle air conditioning system includes a cylinder block having an array of radially arranged cylinders. Each cylinder defines a piston receiving bore that is closed by a discharge valve assembly. A piston assembly is received for reciprocation in each bore by a drive assembly that is operatively connected to the engine of the vehicle. The compressor also includes an annular discharge chamber defined between the periphery of the cylinder block and an outer cylindrical shell. Dams extend into the discharge chamber adjacent the side of the bores closest to a single discharge port; that is downstream of the bores. The dams act as baffles to reflect incident pressure waves to reduce gas pulsations, vibrations and noise.

7 Claims, 3 Drawing Sheets

RADIAL COMPRESSOR WITH DISCHARGE CHAMBER DAMS

TECHNICAL FIELD

The present invention relates generally to radial compressors for vehicle air conditioning systems and, more particularly, to a compressor incorporating a dam or baffle arrangement providing improved pressure pulse attenuation within the compressor.

BACKGROUND OF THE INVENTION

A variety of refrigerant compressors for use in vehicle air conditioning systems are currently available. One popular vehicle compressor design is the radial compressor. Advantageously, radial compressors are relatively compact and lightweight when compared to, for example, variable displacement axial compressors. More particularly, the radially extending pistons occupy a minimum axial length. Accordingly, the compressor housing may be both smaller in size and lighter in weight. This makes the radial compressor particularly suited for utilization in compact vehicles. This is because such vehicles have very limited space within the vehicle engine compartment to accommodate a compressor. This is particularly true with today's vehicles that also incorporate relatively low hood lines for better aerodynamics.

A radial compressor is shown in, for example, U.S. Pat. No. 3,924,968 to Gaines et al, entitled, "Radial Compressor with Muffled Gas Chambers and Short Stable Piston Skirts and Method of Assembling Same", issued Dec. 9, 1975 and assigned to the assignee of the present invention. The disclosure of this patent is incorporated herein by reference.

As shown in the Gaines et al patent, a radial compressor typically includes a rigid cast cylinder housing closed by a cylindrical shell. One pair of oppositely extending cross bores are provided in the housing on a first axis. A second pair of cross bores are provided in the housing on a second axis normal to the first axis.

A piston assembly is received for reciprocal movement in each cross bore. The outer end of each cross bore is closed by a valve assembly including an annular discharge reed plate that controls refrigerant flow through a series of circumferentially spaced discharge apertures. More particularly, the reed plate controls the flow of pressurized gas from the cross bores into an annular discharge chamber.

A drive shaft is supported for rotation on bearings held in the housing. The shaft includes an eccentric driver including a slider block mounted for relative rotation thereon. In operation, rotation of the shaft results in reciprocating movement of the slider block along the two axes to provide reciprocation of the piston assemblies within their respective cross bores. Movement of one piston assembly within its respective cross bore toward the center of the housing causes low pressure refrigerant gas to feed into the bore through a suction reed plate. The opposing piston assembly is simultaneously extended into the opposite cross bore to compress refrigerant gas previously drawn in on its suction stroke. At the proper time and pressure the discharge reed plate opens so that the high pressure gas flows through the apertures in the valve assembly and into the annular discharge chamber. The pressurized refrigerant gas then flows around the discharge chamber mixing in turn with the high pressure gas from the other cylinder bores. A single discharge port in the chamber between two of the cylinders feeds the combined high pressure gas supply to the air conditioning system. The low pressure or spent refrigerant gas returning from the system is recirculated to the compressor through an inlet port in the central section of the housing.

The formation and propagation of high pressure pulsations is a naturally occurring byproduct of compressors of this type. These pulsations are in effect pressure waves in the pressurized refrigerant. If not dampened, these pressure pulsations cause rough operation, and induce significant vibrations in the vehicle that cause an unpleasant sensation to the occupants. This results not only an annoyance, but also is indicative of inefficient compressor operation.

Further, there is a significant noise problem associated with these pressure pulsations within the compressor. It has been found that the noise can even propagate through the connecting lines to the evaporator unit inside the vehicle, where it can be particularly annoying to the occupants. It is believed that in certain air conditioning system installations, the pulsations can even excite other of the system components causing additional sources of vibration and significantly increasing the noise. The vibrations if left unchecked can even lead to premature fatigue and failure of component parts throughout the air conditioning system, but especially within the compressor.

Various attempts have been made to attenuate these pressure pulsations in order to provide smoother and quieter running systems. Many incorporate mufflers that are positioned in the pressurized refrigerant discharge line leading from the compressor discharge port to the condenser unit of the air conditioning system. Such a muffler typically takes the form of a restricted orifice that operates as a flow control device limiting the rate at which pressurized refrigerant is permitted to pass through the refrigerant line. The resulting restriction of refrigerant flow serves to dampen pulsations to a limited extent.

Thus, while relatively effective for this purpose, such mufflers do not provide the best solution to the problem. More particularly, while maintaining the back pressure and heat generation at an acceptable level, the pulsation attenuation that can be gained is limited. Several attempts have been made in the past to change the physical structure of the muffler/restricted devices, but with limited success. Contrary to these previous attempts at redesign of existing devices, we have discovered that pulse attenuation can be more effective if provided at spaced locations around the discharge chamber. Thus, improvement in this direction is the focus of the present invention.

SUMMARY OF THE INVENTION

Accordingly, it is a primary object of the present invention to provide a simple and effective means to reduce pressure pulsations in a compressor, and the noise associated therewith, particularly adapted for use in a radial refrigerant compressor.

Another object of the present invention is to provide a compressor for a vehicle air conditioning system, incorporating spaced restriction means for attenuating pressure pulsations and noise, so as to improve compressor performance in terms of efficiency, reliability, and quietness of operation.

Another object of the present invention is to provide a radial compressor incorporating at least one dam or baffle extending substantially radially and positioned in the discharge chamber immediately downstream of the cylinder bore to reflect back pressure waves, and thus provide the improved compressor performance.

Another object is to provide high pressure pulse attenuation in a radial compressor characterized by improved performance, but also being characterized by relatively low cost with no extra mechanical parts needed, a high degree of reliability/durability and no modification of established assembly procedure of the compressor.

Yet another object of the present invention is to provide a radial refrigerant compressor incorporating a series of dams or baffles around the discharge chamber to reflect the pressure pulsation waves, and provide the improvement in performance desired.

Still another, but related object, is to provide attenuation of pressure pulsations in a compressor of the type described, by providing spaced, substantially radially extending dams to cause established, high pressure pulsing gas flow from the multiple sources within the compressor to mix and interact with reflected or incident pressure waves established at spaced dams.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a new and improved radial refrigerant compressor is provided. The compressor comprises a cylinder block or housing including a plurality of radially arrayed cylinders. Each cylinder defines a piston receiving bore. Piston assemblies are received for reciprocation in the bore of each cylinder. These piston assemblies are driven through a drive shaft, eccentric driver and slider block, substantially in the manner disclosed in the Gaines et al. patent described above.

The cylinder block also includes an inlet port in the central section for feeding refrigerant gas to the cylinders and into the bores. An annular discharge chamber is provided concentrically around and in communication with each of the cylinder bores. This discharge chamber receives compressed refrigerant gas from the bores following compression by the piston assemblies. A discharge port is also provided within the outer section of the cylinder block in communication with the discharge chamber, and serves to direct the compressed refrigerant gas from the compressor to the other components of the vehicle air conditioning system. After conditioning the air being directed to the vehicle passenger compartment, the low pressure or spent refrigerant is returned to the compressor via the inlet port.

As should be appreciated, as each individual piston assembly approaches the completion of a compression stroke, the high pressure refrigerant gas is expelled through the discharge reed valve associated with that piston assembly into the discharge chamber. A brief pressure peak or pulsation is produced at this moment. Thus, as the compressor operates, the refrigerant pressure within the discharge chamber fluctuates in a predictable and periodic wave-like fashion. A series of first generation pulsations occur in the chamber at spaced locations and in sequence as each piston completes its compression stroke.

In accordance with a key aspect of the present invention, these high pressure pulsations and the resulting deleterious vibrations and noise are effectively attenuated at spaced locations within the compressor. In fact, dampening and attenuating of the pulsations is provided directly adjacent the source, and repeated in series as the flow moves to a single discharge port in the annular discharge chamber. In this way the smoothest possible compressor operation is attained. More particularly, a restriction in the form of a dam or baffle is provided extending into the discharge chamber adjacent the side of the cylinder bore between the cylinder and the discharge port. Preferably, one of these downstream dams is associated with each cylinder to serve to restrict the flow of refrigerant through the discharge chamber. This restriction of flow serves to dampen the pressure pulsations in a manner described in greater detail below.

Preferably, the dams are integrally formed on the cylinder block and form an extension of the outer end of each cylinder bore nearest the discharge port. The dams extend into the discharge chamber toward the outer annular shell a sufficient distance to effectively restrict flow by about 50% of normal flow; the normal flow being represented in the prior art Gaines et al patent, referenced above. The restriction is not so severe as to significantly reduce compressor performance by excess back pressure or heat generation.

As the dams are positioned adjacent the discharge valve assembly at the end of each cylinder bore, the dams are in the necessary position to intercept the main pressure pulsations immediately adjacent their origin. More particularly, the pressure waves in the refrigerant gas being discharged from any of the bores immediately engage the adjacent downstream dam. Accordingly, incident pressure waves are reflected backward toward the source. The resulting mixing and interference action causes opposing pressure waves to cancel each other out. Hence, pressure pulsations are substantially attenuated within the compressor, preferably at the spaced locations defined by the cylinders. Accordingly, vibrations are reduced and the compressor operates smoother. This leads to improvements in reliability and noise reduction not only in the compressor, but also throughout the components of the air conditioning system.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail the present preferred embodiment of the invention, an example of which is illustrated in the accompanying drawing.

DETAILED DESCRIPTION OF THE INVENTION

Figure 1:
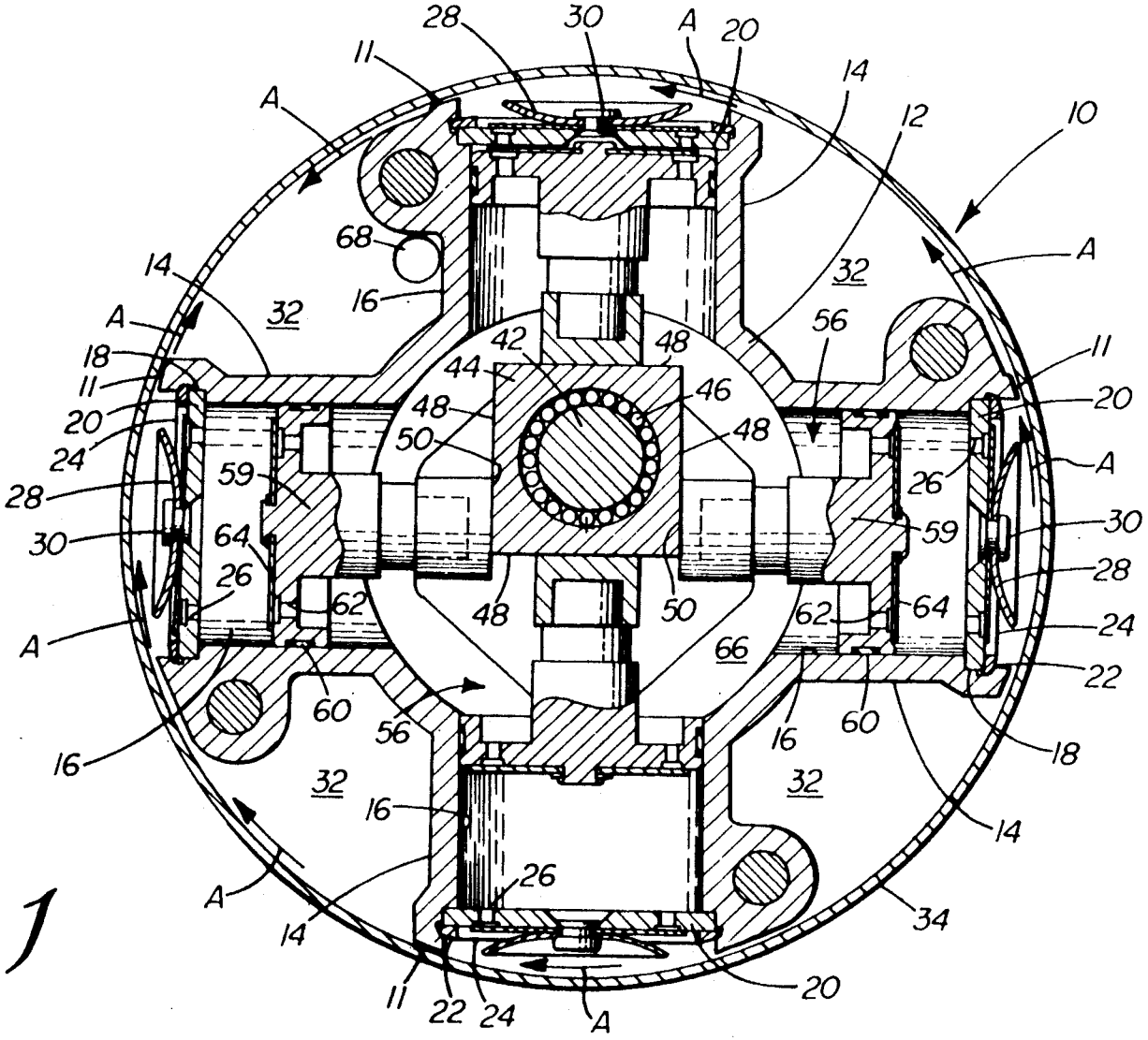
FIG. 1 is a cross sectional view through the cylinder block along the center line of the bores of a radial compressor incorporating the concepts of the present invention including spaced dams in the discharge chamber for attenuating pressure pulsations.
Figure 2:
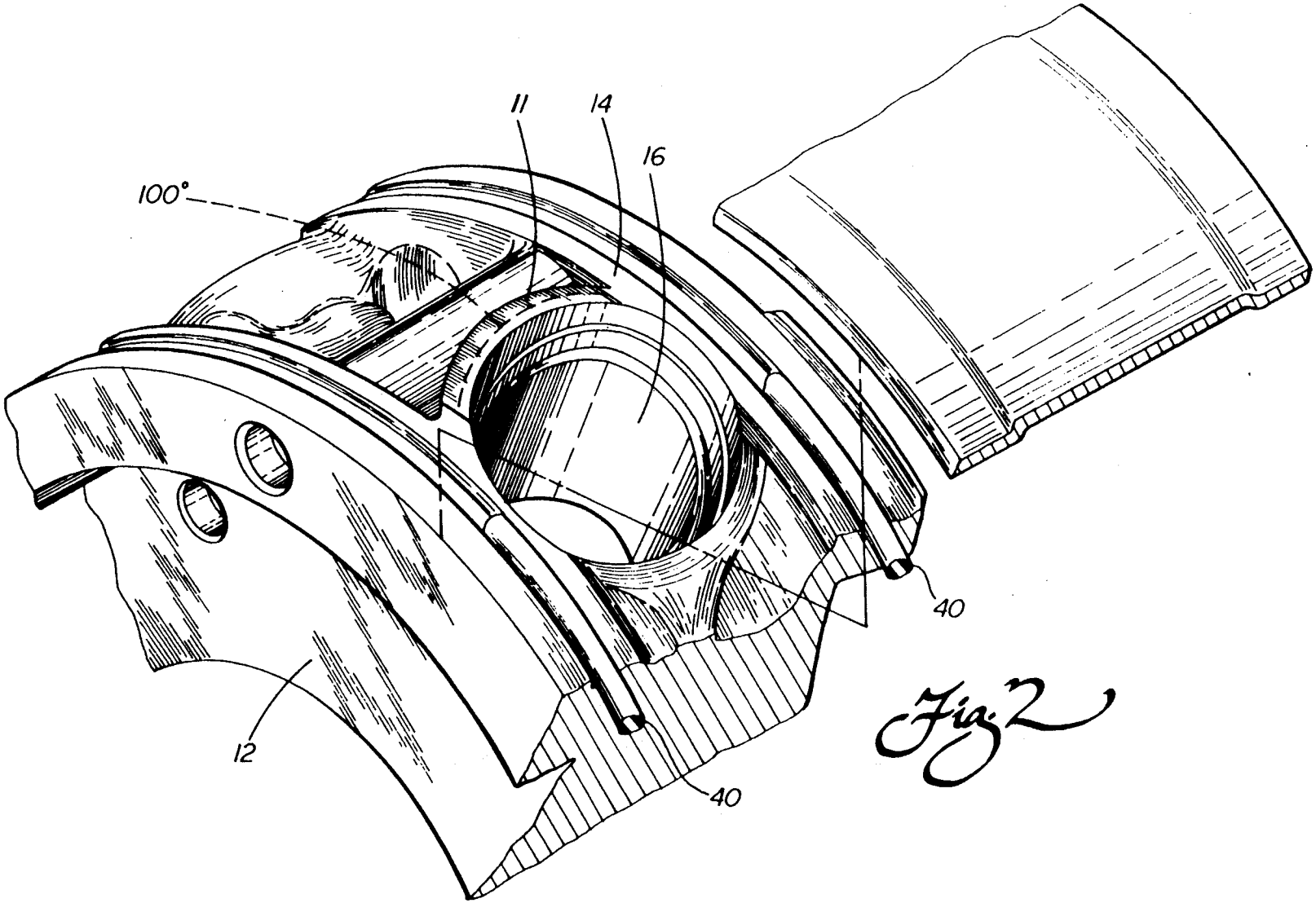
FIG. 2 is a detailed perspective view of the outer end of one of the cylinders of the radial refrigerant compressor shown in FIG. 1, showing the formation of a dam integral with the top of the cylinder bore.

Reference is now made to FIG. 1, showing in section radial compressor 10 of the present invention. The compressor 10 incorporates dams or baffles 11 to restrict flow of compressed refrigerant gas being discharged from the cylinder bores. As will be better appreciated from a review of the detailed description provided below, the dams 11 are effective to provide improved pressure pulse attenuation during operation of the compressor. Preferably, the dams 11 are rigid, stationary structures extending in an arc and formed integrally as a raised extension along one side of the cylinders (see FIG. 2). Accordingly, the objective of being low cost, providing highly durable and maintenance free operation and not requiring a change in established assembly procedures (as covered in the Gaines et al patent '968) is clearly met.

As shown best in FIG. 1, the compressor 10 utilizes a rigid cast cylinder housing 12 of a suitable metal, such as an aluminum alloy. This housing 12 incorporates oppositely extending cylinders 14; one pair of cylinders 14 extending along a first axis of the housing 12, while another pair extending along a second axis of the housing and normal to the first axis. Each of the cylinders 14 includes a bore 16. Each of the bores 16 terminates in a diametrically enlarged counter bore 18. A valve plate 20 is positioned in the counter bore 18 and is retained in position against the inner shoulder by means of a snap ring 22 received in an opposing groove.

An annular discharge reed plate 24 controls flow through a series of circumferentially spaced discharge apertures 26. The discharge reed plate 24 is retained in position by means of a retaining plate 28. The entire valve assembly is secured together by means of a rivet 30 in a central aperture in the valve plate 20.

As is known in the art, the reed plate 24 controls the flow of pressurized gas into an annular discharge chamber 32. The housing 12 is circular in form and is enclosed around its outer periphery by a cylindrical shell or band 34. As shown, the annular discharge chamber 32 is formed around the entire periphery between the housing 12 and this shell 34, which is retained in position by a plurality of pins or the like, in a manner known in the art and thus not shown. 0-ring seals 40 are received in cooperating grooves (FIG. 2) in the housing 12 to provide a fluid tight arrangement for the discharge chamber 32.

As is also known in the art, the compressor 10 is driven through an eccentric drive shaft 42 that is connected through an electromagnetic clutch to a pulley (not shown). The pulley is connected by a belt to the engine of the vehicle (also not shown). A slider block 44 is mounted to the eccentric drive shaft 42 for relative rotation between the shaft and the block via a plurality of separate, elongated needle bearings 46. As shown in FIG. 1, the slider block 44 includes outer facing drive surfaces 48 adapted to engage a reduced stem portion of piston assemblies 56.

As shown, each piston assembly 56 includes a circular array of inlet apertures 62 that are normally closed by a suction reed plate 64. The reed plate 64 is operative to regulate the flow of low pressure gas into the cylinder bore 16 from inlet chamber 66 in the center section of the housing 12.

In operation, rotation of the drive shaft 42 results in reciprocating movement of the slider block 44 along the two defined axes, thus providing reciprocation of the piston assemblies 56 within their respective bores 16. Movement of one of the piston assemblies 56 within its respective cross bore toward the center section of the housing 12 causes the refrigerant gas in the chamber 66 to deflect the suction reed plate 64 forcing refrigerant gas into the associated bore 16. Simultaneously the opposed piston assembly 56 is being extended so as to compress refrigerant. This serves to deflect the discharge reed plate 24 providing pressurized refrigerant gas flows through the apertures 26 into the annular discharge chamber 32. The refrigerant gas establishes a split flow path around the chamber 32 toward the discharge port 68 (see flow arrows A in FIG. 1 extending from the remote cylinders 14 at the 3 and 6 o'clock locations).

Each high pressure discharge from each of the bores 16 produces a pressure pulsation in the discharge chamber 32. In order to attenuate these pulses and the attendant vibrations and noise, each dam 11 serves to restrict the pressurized gas flow not only from the adjacent cylinder bore 16, but also from any upstream bore. The dam 11 extends radially about an arc of substantially 100 degrees so as to effectively restrict flow all the way across the discharge chamber 32 (see also FIG. 2).

Each dam 11 extends radially outwardly from the end of the cylinder 14 so as to be sufficient to restrict, but not block the flow path to the discharge port 68. In the preferred embodiment, the normal flow is restricted by approximately 50%. More particularly, in the preferred embodiment the normal, slot-like passage across the chamber 32 is reduced or restricted by the dam from a vertical clearance of approximately 0.18 inches to approximately 0.09 inches. The standard prior art passage is provided on the opposite side of the cylinder With an opening width of approximately 1.75 inches, the restricted area or opening over the dam 11 is approximately 0.16 square inches; the opposite passage being approximately 0.315 square inches. This relationship establishes a ratio of the normal passage to the restricted opening of approximately 2:1. For a compressor 11 having a displacement of 2.75 cubic inches per cylinder, a ratio of displacement to the restricted opening area above the dam 11 of approximately 17.2:1 is established. Taking into account the thickness of the dam 11, a ratio of the displacement to the volume of the restricted opening of approximately 68.8:1 is established.

In accordance with the preferred embodiment, each dam 11 is placed only on the top of the downstream side of the related cylinder. In this manner, the refrigerant gas must forcibly traverse the dam 11 immediately following compression. Thus, direct access to the discharge port 68 is cut off from any high pressure pulse.

For the remote cylinders 14 (see cylinders 14 at 3 and 6 o'clock in FIG. 1), the pressurized gas pulses must traverse two dams in series along the flow path to the discharge port 68.

Each new refrigerant gas pulse from a bore 16, coupled with and associated pressure pulsations already in the chamber 32, are forced to reflect back from the dam 11 directly against the direction of established refrigerant flow. In this manner each dam 11 acts as a baffle to cause the established flow stream and newly discharged gas to interfere with each other and be mixed. This interference and mixing serves to efficiently attenuate the pressure pulsations at these spaced locations. Accordingly, vibration and noise, both within the compressor and throughout the air conditioning system, are dampened or suppressed.

Figure 3:
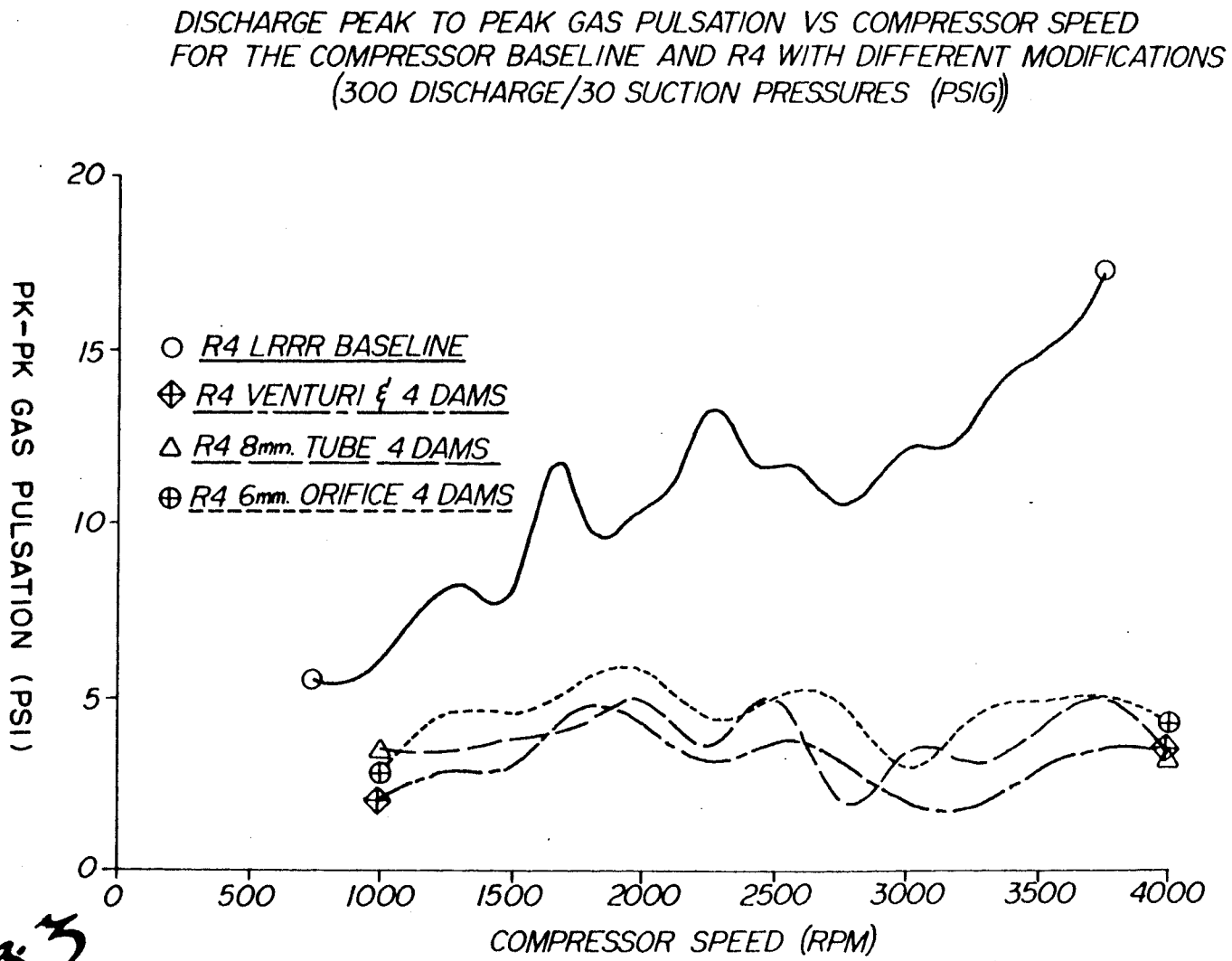
FIG. 3 is a graph illustrating peak-to-peak gas pulsation over the normal operating speeds of the compressor.

It should also be appreciated that the attenuation efficiency may be gauged by measuring peak-to-peak gas pulsation over the normal operating speeds of the compressor 11. As shown in FIG. 3, the attenuation of the pulses is substantial utilizing the four downstream dams 11 as compared to the baseline compressor with a standard open discharge port 68.

While four dams 11 are the preferred embodiment, more or less may be used in accordance with the broad aspects of the present invention. For example, the dams 11 at the remote cylinders (3 and 6 o'clock positions, FIG. 1) could be reduced or eliminated if less attenuation is needed, since in this instance all pulsations in the annular discharge chamber 32 would have to transverse at least the two dams closest to the discharge port 68 (9 and 12 o'clock positions). On the other hand, dams could be added on the upstream side of all cylinders 14, so that substantially double pressure wave reflection, interference flow and turbulence is generated. In all instances, the normal operating parameters of the compressor 11 should be maintained to avoid excess gas back pressure on the piston assemblies 56 and heat generation, which in turn can adversely affect the efficiency of operation. It has been found that standard operating pressures and temperatures can be easily maintained with the preferred embodiment illustrated. The cylindrical shell 34 is designed to flex or bow slightly outwardly, to provide relief in the unlikely event that pressure should momentarily build up beyond the design pressure adjacent one of the dams 11.

In summary, numerous benefits result from employing the concepts of the present invention. The dams 11 may be formed as an integral part of the cast cylinder block or housing, thus minimizing the cost of manufacture. Furthermore, since the dams 11 are rigid and stationary structures, durability and reliability are maximized. Additionally, the dams 11 may be incorporated into radial compressors of present day design without adversely affecting in any manner the method of assembly of the compressor.

By effectively attenuating and dampening pressure pulsations, the compressor operates more smoothly and efficiently. Additionally, less stress and fatigue is placed on the component parts, so that the service life of the compressor and the entire air conditioning system is enhanced.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A radial compressor for compressing a refrigerant gas in an air conditioning system, comprising:

a cylinder block including a plurality of radially arrayed cylinders defining piston receiving bores;

piston means received for reciprocation in the bore of each cylinder;

means for driving said piston means in said bores;

means for providing low pressure refrigerant to said cylinders and into said bores;

an annular discharge chamber defined by an outer shell for receiving compressed, high pressure refrigerant gas from said bores;

a discharge port providing in communication with said discharge chamber for receiving the high pressure refrigerant gas; and dam means extending from a first arcuate portion of one of said bores into said discharge chamber between at least one of said cylinders and said discharge port to a position more closely adjacent said outer shell than a second, opposing arcuate portion of said bore, to define a restricted flow passes for restricting pulsing flow of refrigerant gas through said discharge chamber and reflecting incident pressure waves so as to restrict pulsing flow through said discharge chamber and reflect pressure waves to thereby significantly attenuate gas pulsations, vibration and noise associated therewith.

2. The radial refrigerant compressor set forth in claim 1 wherein a separate dam means is provided adjacent each cylinder.

3. A radial compressor for compressing a refrigerant gas in a vehicle air conditioning system, comprising:

a cylinder block including a plurality of radially arrayed cylinders defining piston receiving bores;

piston means received for reciprocation in the bore of each cylinder;

means for driving said piston means in said bores;

means for feeding refrigerant to said cylinders and into said bores;

a cylindrical shell mounted about said cylinder block defining an annular discharge chamber between said shell and said cylinder block for receiving compressed, high pressure refrigerant gas from said bores;

a discharge port providing in communication with said discharge chamber for receiving the high pressure refrigerant gas; and dam means on said cylinder block and forming an extension of each bore into said discharge chamber, said dam means being on a first side of said bore nearest to said discharge port and extending to a position more closely adjacent said outer shell than a second, opposing side of said bore to define a restricted flow passage so as to directly restrict pulsing a flow through said discharge chamber and reflect incident pressure waves to thereby significantly attenuate gas pulsations, vibration and noise associated therewith.

4. The radial refrigerant compressor set forth in claim 3, wherein said dam means extends toward said cylindrical shell into said chamber so as to provide a restricted opening downstream of said cylinder bores above said dam means, the ratio of displacement of one cylinder bore to the area of the restricted opening being approximately 17.2:1.

5. The radial refrigerant compressor set forth in claim 3, wherein the discharge chamber includes a flow passage upstream of each cylinder bore, the ratio of said passage to said restricted opening is approximately 2:1.

6. The radial refrigerant compressor set forth in claim 3, wherein said dam means extends toward said cylindrical shell into said chamber so as to provide a restricted opening downstream of said cylinder bores above said dam means, the ratio of displacement of one cylinder bore to the volume of the restricted opening being approximately 68.8:1.

7. The radial refrigerant compressor set forth in claim 3, wherein said dam means extends toward said cylindrical shell into said chamber so as to provide a restricted opening downstream of said cylinder bores above said dam means, said dam means extending in an arc of substantially 100°.

* * * * *